US009282601B2

(12) United States Patent
Lau

(10) Patent No.: US 9,282,601 B2
(45) Date of Patent: Mar. 8, 2016

(54) METHOD FOR IMPROVING OPERATION LIFETIME OF CAPACITOR, CAPACITOR CONTROL CIRCUIT STRUCTURE AND USE THEREOF

(76) Inventor: Ping Cheung Michael Lau, Hong Kong (HK)

( * ) Notice: Subject to any disclaimer, the term of this patent is extended or adjusted under 35 U.S.C. 154(b) by 727 days.

(21) Appl. No.: 13/474,291

(22) Filed: May 17, 2012

(65) Prior Publication Data

US 2013/0307436 A1 Nov. 21, 2013

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.
CPC ..... *H05B 33/0815* (2013.01)

(58) Field of Classification Search
USPC ..... 307/109
See application file for complete search history.

(56) References Cited

U.S. PATENT DOCUMENTS

| | | | | |
|---|---|---|---|---|
| 6,205,012 | B1 * | 3/2001 | Lear | H01F 13/003 361/139 |
| 2005/0270723 | A1 | 12/2005 | Kwon | |
| 2007/0047100 | A1 * | 3/2007 | Takahashi | H02J 9/061 359/689 |
| 2008/0032473 | A1 * | 2/2008 | Bocek | H01G 9/28 438/253 |
| 2008/0094775 | A1 * | 4/2008 | Sneh | H01G 4/10 361/275.3 |
| 2010/0146333 | A1 * | 6/2010 | Yong | G06F 1/305 714/14 |
| 2011/0134585 | A1 * | 6/2011 | Shen | H01G 11/36 361/502 |
| 2012/0062134 | A1 * | 3/2012 | Kou | H05B 33/089 315/205 |
| 2012/0104970 | A1 * | 5/2012 | Okubo | H05B 33/0887 315/291 |
| 2012/0197450 | A1 * | 8/2012 | Krok | H02J 3/16 700/291 |
| 2013/0257228 | A1 * | 10/2013 | Noguchi | H01L 41/0815 310/357 |
| 2013/0307436 | A1 * | 11/2013 | Lau | H05B 33/0815 315/291 |
| 2014/0029308 | A1 * | 1/2014 | Cojocaru | H01G 4/38 363/13 |
| 2014/0246915 | A1 * | 9/2014 | Mumtaz | H01L 31/02021 307/86 |
| 2014/0300274 | A1 * | 10/2014 | Acatrinei | H05B 33/0815 315/85 |

FOREIGN PATENT DOCUMENTS

| | | | |
|---|---|---|---|
| CN | 101900269 | A | 12/2010 |
| CN | 102136370 | A | 7/2011 |
| CN | 102222568 | A | 10/2011 |
| JP | 54126546 | A * | 10/1979 |
| JP | 2005117792 | A * | 4/2005 |

* cited by examiner

*Primary Examiner* — Adam Houston
(74) *Attorney, Agent, or Firm* — Rabin & Berdo, P.C.

(57) ABSTRACT

The invention provides a method for improving operation lifetime of a capacitor module in an electronic circuit employing the capacitor module, comprising the steps of providing two or more capacitor modules of same configuration; and controlling alternately a respective one of the capacitor modules to operate in the electronic circuit for a first predetermined period of time. The invention also relates to a capacitor control circuit structure for use in a location of an electronic circuit previously occupied by an original capacitor module, and the capacitor control circuit structure exhibits the extended operation lifetime with respect to the original capacitor module. The invention also relates to the use of the capacitor control circuit structure in the electronic applications.

12 Claims, 12 Drawing Sheets

METHOD FOR IMPROVING OPERATION LIFETIME OF CAPACITOR, CAPACITOR CONTROL CIRCUIT STRUCTURE AND USE THEREOF

FIELD OF THE INVENTION

The present invention is generally related to the field of capacitors. More specifically, the present invention concerns a method for regulating the operation of capacitors to extend their operation lifetime in an electronic circuit employing the capacitors, and a capacitor control circuit structure exhibiting an extended operation lifetime.

BACKGROUND OF THE INVENTION

Capacitors are an essential electronic component in the electronic circuits. The capacitors are widely used in power supply filter circuits for smoothing electric power, signal coupling circuits, resonant circuits and the like. The electrolytic capacitors are one type of the capacitors and have in recent years come to be used in a variety of applications. However, the electrolytic capacitors have a relatively short operation lifetime, and thus the lifetime of many electronic circuits is directly linked to the lifetime of the electrolytic capacitors inside. For example, LEDs (light-emitting diodes) are a solid state light source with long lifetime of about 50 to 100 thousand hours, while the electrolytic capacitor has a lifetime of about 3 to 6 thousand hours. In other words, the operation lifetime of the LEDs is considerably influenced by the electrolytic capacitor used in the filter and driver circuit of the LEDs.

The electrolytic capacitor uses an electrolyte, an ionic conducting liquid, in its construction. The internal wet electrolytic chemical in the electrolytic capacitor can evaporate as it ages and therefore it will eventually fail. Generally, the load life of an electrolytic capacitor reflects the amount of changes to the fundamental electrical performance of an electrolytic capacitor under certain loading conditions in order to show the effect of aging in the capacitor while operating in a circuit. Because the higher temperature accelerates the evaporation of the electrolytic chemical, the temperature at which the load life is conducted typically indicates the maximum operating temperature rating for the electrolytic capacitor recommended by the manufacturers. The electrolytes used in the electrolytic capacitor evaporates, the load life of the electrolytic capacitor is thus rated in hours at a set temperature.

It is a general knowledge in the art of electronic and/or electrical engineering that the electrolytic capacitor gradually fails as it ages and accordingly its ESR (equivalent series resistance) increases. Since the ESR determines the amount of power loss when the capacitor is used in the filter circuit to smooth voltage, it should be kept as small as possible. The power loss in the electrolytic capacitor varies with the square of the ripple current flowing through it and is proportional to the ESR. The Low ESR is a key factor for high efficiencies in power supplies. As the electrolytic capacitor in the electronic circuit ages during normal use, its ESR will increase. Consequently the electrolytic capacitor can no longer provide its function as it is intended in the electronic circuit.

FIG. 1 shows a typical AC-DC step down rectification circuit using an electrolytic capacitor to smooth the DC voltage after rectification in the prior art. This circuit includes an isolation transformer T1 to lower a household AC voltage, for example 220 volts, to a lower voltage; a full wave bridge rectification circuit consisting of 4 diodes, D1, D2, D3 and D4, which converts the stepped-down AC voltage into the DC voltage; and an electrolytic capacitor Ecap1 for smoothing out the DC voltage.

FIG. 2*a* shows a normal DC output voltage waveform across the electrolytic capacitor Ecap1 for the step down AC-DC rectification circuit as shown in FIG. 1. FIG. 2*b* shows a simulated output voltage waveform with the ESR of the electrolytic capacitor Ecap1 turned infinitely large as if the capacitor is an open circuit. As shown in FIG. 2*b*, when the ESR increases to infinity to simulate the worst case scenario in the aging of the electrolytic capacitor Ecap1, the capacitor may fail to provide its intended function to smooth the output voltage. Since the AC-DC rectification circuit is usually used to power another electronic circuit, the failure in the electrolytic capacitor due to aging can negatively impact the functionality and performance of the electronic circuit as a whole.

Enormous amounts of time and efforts have been expended in an attempt to maximize the lifetime of the electrolytic capacitors as possible. For examples, the improvements in the lifetime of the capacitors can be known from US2005/0270723A1, CN101900269A, CN102222568A, and CN102136370A. However, these improvements merely relate to the structural modification of the capacitors per se.

Therefore, there is a need for a new method of regulating the operation of the capacitors in a circuit application, which can make a cost-effective improvement on the operation lifetime of the capacitors.

SUMMARY OF THE INVENTION

The present invention has been developed to fulfill the need noted above and therefore has a principle object of the provision of a novel method which attempts to fulfill the task of extending the operation lifetime of a capacitor for use in the electronic circuit. The nature of the invention focuses on deploying two or more capacitor modules of same configuration and enabling the capacitor modules to take turns to operate in the electronic circuit, such that, at any moment in operation of the electronic circuit, only one of the capacitor modules is allowed to operate and each of the capacitor modules is made to generally equally share the operation time in the electronic circuit to maximize the operation lifetime of the capacitor modules employed in the electronic circuit.

The term "capacitor module" used hereinafter refers to a single one capacitor used in electronic applications; or a module used in electronic applications, which contains some fixed number of capacitors deployed in series and/or parallel.

For two or more capacitor modules, if one of the capacitor modules fails much earlier than the other, then probably the failed module has to be taken out of service and thus the lifetime of each capacitor module in the electronic applications cannot be maximized as possible. It would be very desirable if each module could be made to have the substantially same operation lifetime.

These and other objects and advantages of the invention are satisfied by providing a method for improving the operation lifetime of a capacitor module, for example an electrolytic capacitor module, in an electronic circuit employing the capacitor module, comprising the steps of:

providing two or more capacitor modules of same configuration; and controlling alternately a respective one of the capacitor modules to operate in the electronic circuit for a first predetermined period of time.

In one embodiment of the invention, the method further comprises the step of identifying the capacitor module that is in use before the electronic circuit is turned off and determining how much time is left until termination of the first predetermined period of time for said capacitor module, such that said in-use capacitor module before the turn-off is resumed to operate for the left time period when the electronic circuit is turned on to rerun.

The controlling step may be preferably performed by a microcontroller with a memory device, and the memory device stores data about operation records and updates of the capacitor modules.

In another embodiment of the invention, the controlling step comprises always actuating a first one of the capacitor modules to operate for half of the first predetermined period time every time the electronic circuit is turned on. Beginning with a second one of the capacitor modules, each of the capacitor modules is alternately controlled to operate in the electronic circuit for the first predetermined period of time, after the operation of the first capacitor module for half of the first predetermined period.

Preferably, the method comprises the step of configuring the respective capacitor module and a ready-to-operate one of the capacitor modules to operate concurrently in the electronic circuit for a second predetermined period of time before the operation of the respective capacitor module is disenabled.

A second aspect of the invention is to provide a capacitor control circuit structure for use in a location of an electronic circuit previously occupied by a capacitor module (referred to as "an original capacitor module" herein below). The capacitor control circuit structure comprises:

two or more capacitor modules of same configuration;

at least one switching device in operative connection with a respective one of the capacitor modules; and a capacitor module controller for alternately controlling the operative connection of the at least one switching device with the respective one of the capacitor modules for a first predetermined period of time, such that the respective capacitor module is actuated to operate in the electronic circuit during the first predetermined period of time.

A voltage regulator is preferably arranged prior to the capacitor module controller in order to ensure that the controller functions properly.

In one preferred embodiment of the invention, the capacitor module controller is configured as a microcontroller programmed to alternately control each of the capacitor modules to operate in the electronic circuit for the first predetermined time period. The microcontroller may be designed or an external memory coupled to the microcontroller may be provided to store data about operation records and updates of the capacitor modules to identify the capacitor module that is in use before the electronic circuit is turned off and to determine how much time is left until termination of the first predetermined time period, thereby enabling the microcontroller to resume the operation of the last-in-use capacitor module for the left time period when the electronic circuit is turned on to rerun.

In another preferred embodiment of the invention, the capacitor module controller is configured as a programmable counter or a microcontroller (MCU) to always actuate a first one of the capacitor modules to operate for half of the first predetermined time period every time the electronic circuit is turned on; after the half of the first predetermined time period, the counter or the MCU, beginning with a second one of the capacitor modules, alternately controls each of the capacitor modules to operate in the electronic circuit for the first predetermined time period.

Advantageously, the capacitor module controller may be configured to enable the respective capacitor module and a ready-to-operate one of the capacitor modules to operate concurrently in the electronic circuit for a second predetermined period of time before the operation of the respective capacitor module is disenabled.

In one specific embodiment of the invention, the switching device is configurable as a transistor for the respective capacitor module, so that each of the capacitor modules has its own switcher in operative connection with the capacitor module controller. In this way, the controller is able to control the operative connection of the transistor with the respective capacitor module to enable the operation of the respective capacitor module.

A third aspect of the invention relates to the use of the capacitor control circuit structure in a driver circuit for a LED lamp.

Unlike the prior art technologies which permit the extended operation lifetime of the electrolytic capacitors by altering the construction and/or the material of the capacitors, the invention is characterized by providing two or more capacitor modules of same configuration which are configurable to take turns to operate in the electronic circuit, such that, at any moment in operation of the electronic circuit, only one of the capacitor modules is allowed to operate and each of the capacitor modules is made to generally equally share the operation time in the electronic circuit. By this method, the operation lifetime of the capacitor modules in the electronic circuit is permitted to be extended.

With each capacitor module in operation for an equal time period, the capacitor control circuit structure of the invention exhibits the extended operation lifetime with respect to the original capacitor module. In particular, the capacitor control circuit structure of the invention exhibits a double, triple or even longer operation lifetime with respect to the original capacitor module, depending on the number of the capacitor modules included in the capacitor control circuit structure. Assuming that the operation lifetime of the original electrolytic capacitor module used in an electronic circuit is 2000 hours at 105 degree Celsius, if this electrolytic capacitor module is replaced by the capacitor control circuit structure of the invention including two electrolytic capacitor modules having the same configuration as the original capacitor module in the electronic circuit, at least in theory, the capacitor control circuit structure of the invention extends the operation lifetime of the original capacitor module that it replaces in the electronic circuit to a total of 4000 hours.

The objects, characteristics, advantages and technical effects of the invention will be further elaborated in the following description of the concepts and structures of the invention with reference to the accompanying drawings.

DETAILED DESCRIPTION OF THE INVENTION

The essence of the method of the invention will be clear from the following description of the capacitor control circuit structure in connection with the drawings. While this invention is illustrated and described in preferred embodiments, the capacitor control circuit structure may be produced in many different configurations, sizes, forms and materials.

Figure 1:
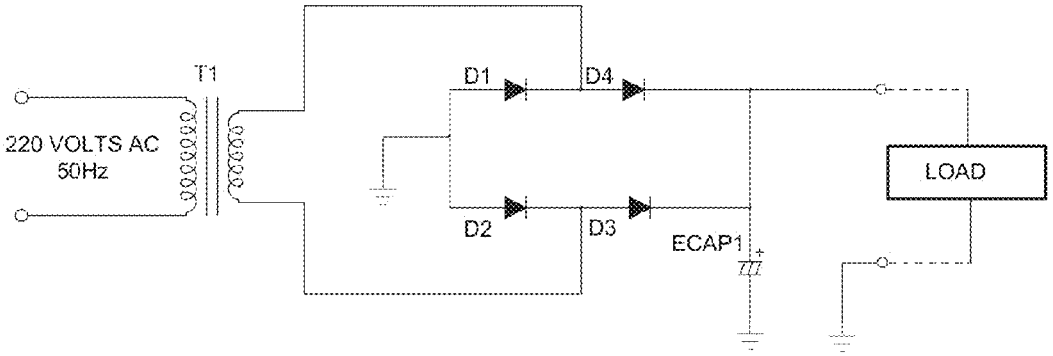
Fig. 1 (Prior Art)
FIG. 1 is a typical AC-DC step down rectification circuit using an electrolytic capacitor to smooth the DC voltage after rectification in the prior art.
Figure 2A:
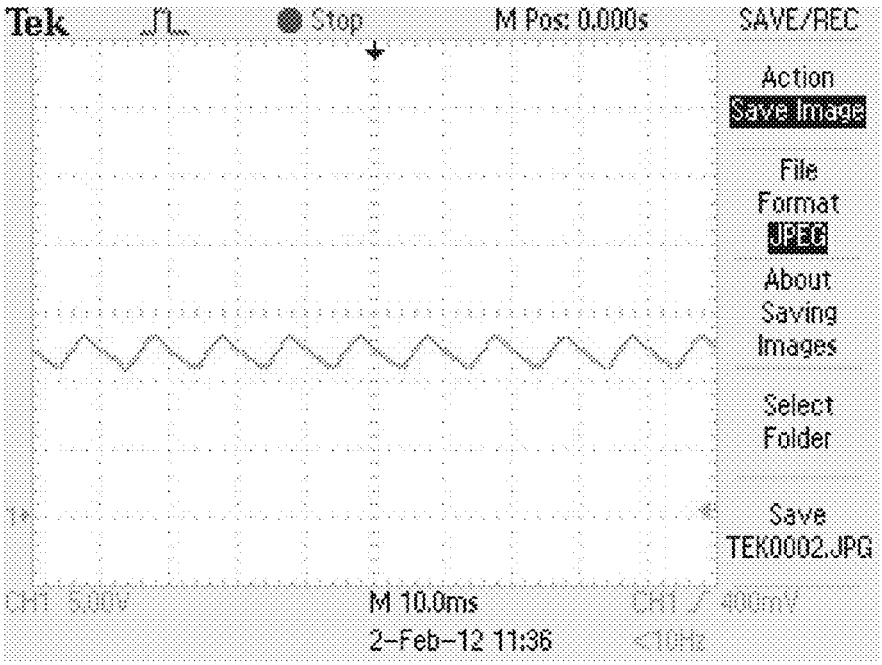
FIG. 2*a* is a normal DC output voltage waveform across the electrolytic capacitor Ecap1 for the step down AC-DC rectification circuit as shown in FIG. 1.
Figure 2B:
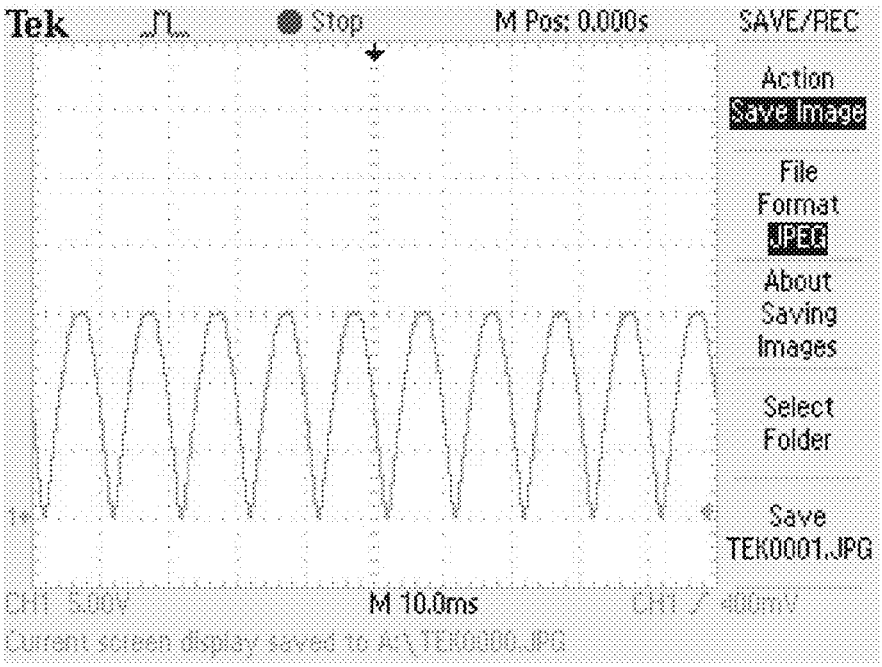
FIG. 2*b* shows a simulated output voltage waveform with the ESR of the electrolytic capacitor Ecap1 turned infinitely large as if the capacitor is an open circuit.
Figure 3:
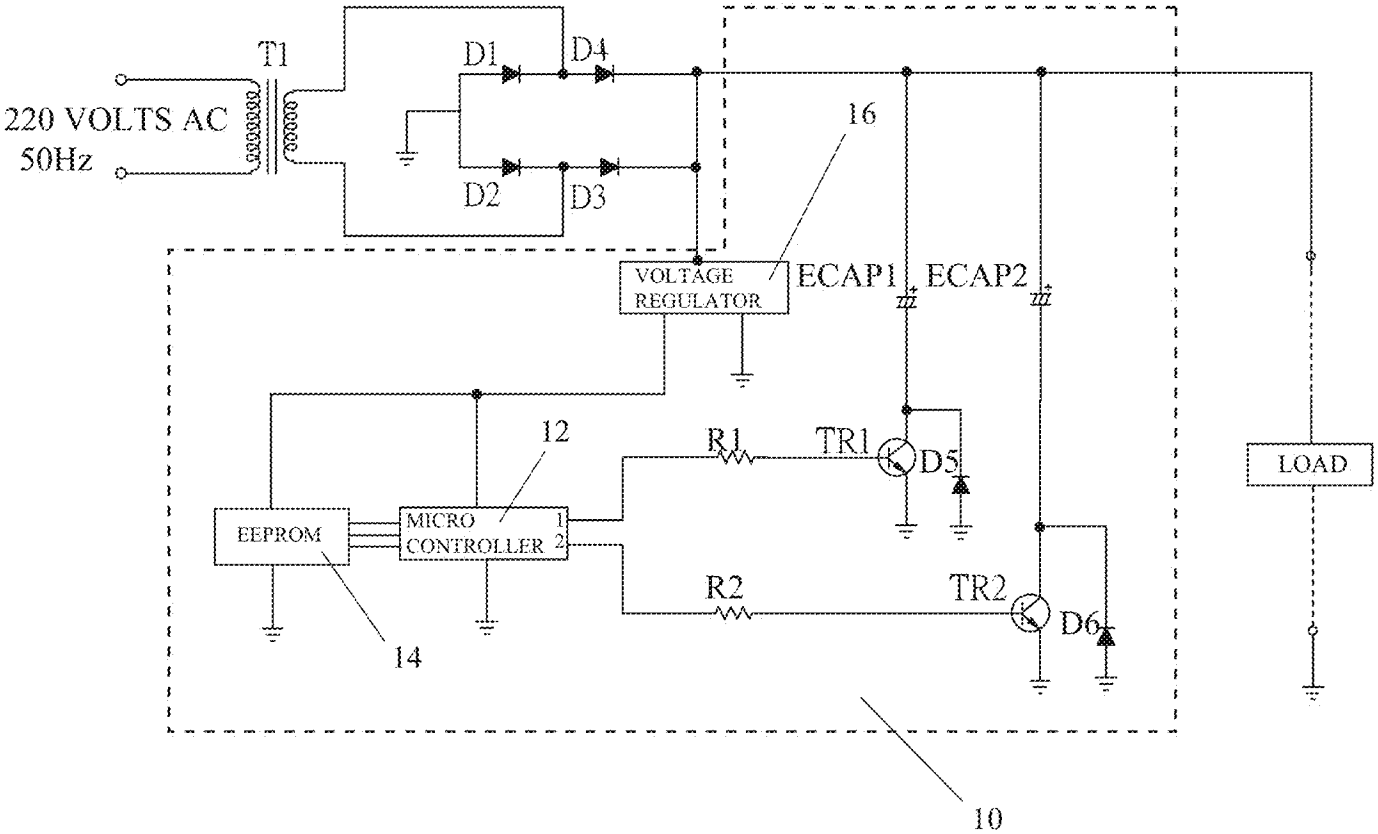
FIG. 3 is a capacitor control circuit structure constructed according to a first embodiment of the invention, which is used in the AC-DC step down rectification circuit of FIG. 1.

Referring now to the drawings, FIG. 1 is a typical AC-DC step down rectification circuit using an original capacitor module consisting of a single one electrolytic capacitor to smooth the DC voltage after rectification in the prior art. FIG. 3 provides a capacitor control circuit structure 10 constructed consistent with a first embodiment of the invention, which is used in the step down rectification circuit of FIG. 1 to take the place of the original electrolytic capacitor module. In this embodiment, the capacitor control circuit structure 10 comprises first and second electrolytic capacitor modules Ecap1 and Ecap2, a general purpose microcontroller (MCU) 12 as a capacitor module controller, an external EEprom memory device 14, a voltage regulator 16 for powering the MCU 12, a first transistor TR1 with two of its terminals in respective connection with the first capacitor module Ecap1 and the common ground of the circuit and the third terminal with a first pin 1 of the MCU 12, and a second transistor TR2 with two of its terminals in respective connection with the second capacitor module Ecap2 and the common ground of the circuit and the third terminal with a second pin 2 of the MCU 12. The first and second electrolytic capacitor modules Ecap1 and Ecap2 have the same configurations and same function as the original electrolytic capacitor module shown in FIG. 1. The MCU 12 is electronically coupled to the electronic circuit. Since the operating voltage of the MCU1 may be different from the output voltage of the AC-DC step down rectification circuit, the voltage regulator 16 is included in the capacitor control circuit structure 10 to provide the adequate operating voltage for the MCU 12.

As illustrated, the capacitor modules Ecap1 and Ecap2 are not simply connected in parallel. Because if they are connected in parallel and/or in series, the two electrolytic capacitor modules will both function to smooth the voltage together and age together simultaneously. Therefore by simply connecting two electrolytic capacitor modules in parallel and/or in series, there would be no improvement on the operation lifetime of the capacitor modules.

The MCU 12 and the transistors TR1 and TR2 are included such that the two capacitor modules Ecap1 and Ecap2 are alternately actuated to operate for an equal time period in the step down rectification circuit. Thus, the operation lifetime of the two capacitor modules in this capacitor control circuit structure will be doubled in the circuit.

Figure 4:
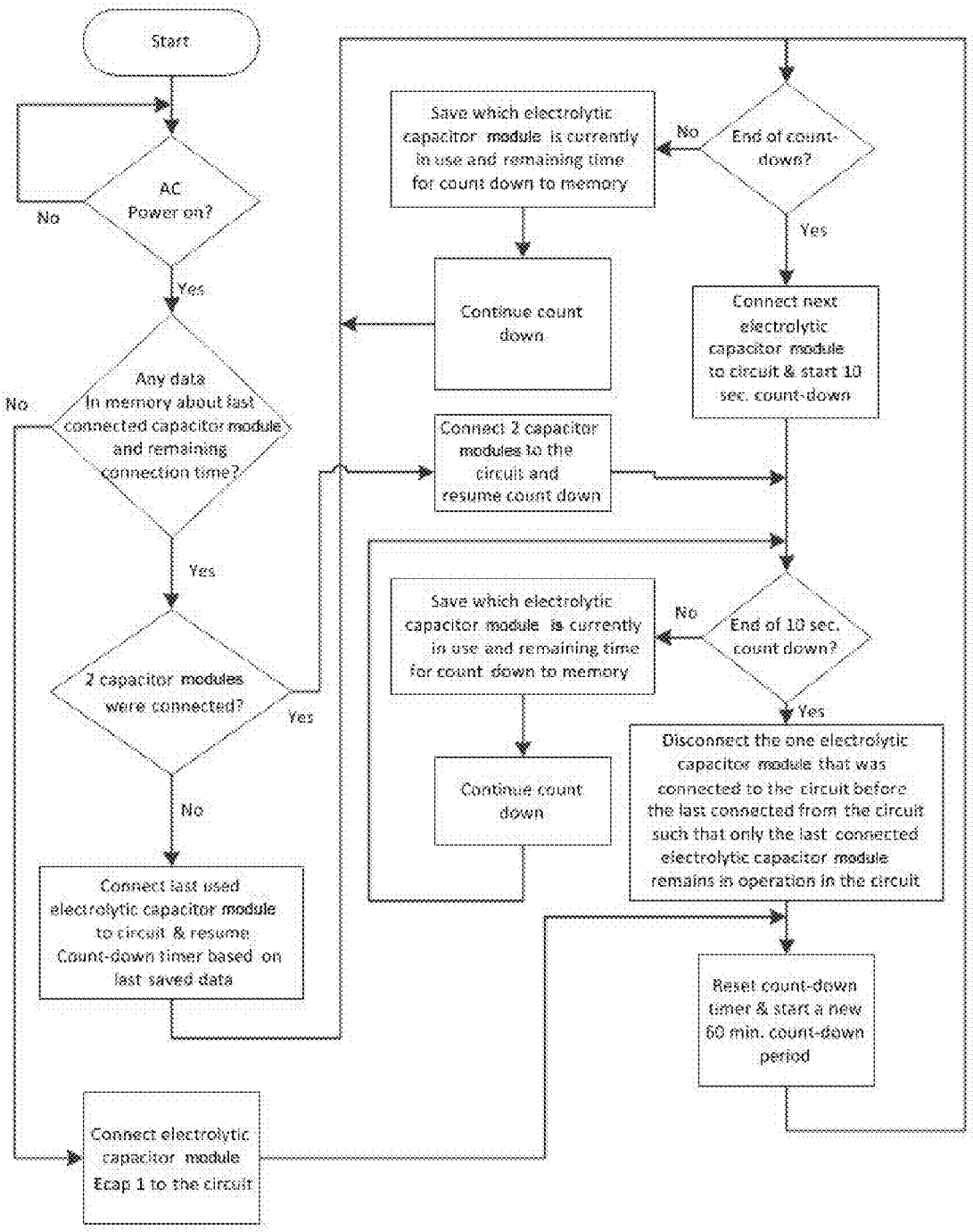
FIG. 4 is a flow chart showing the control algorithm of the capacitor control circuit structure of FIG. 3.

FIG. 4 is a flow chart showing the control algorithm of the capacitor control circuit structure 10. When the electric power is applied, the MCU 12 turns on the transistor TR1 by applying a logic 1 at its pin 1, which only allows the transistor TR1 to connect the capacitor module Ecap1 to form a closed loop with the step down rectification circuit so as to smooth the DC voltage. Simultaneously the MCU 12 starts an internal countdown timer with a countdown period of, for example, 60 minutes. At the end of the 60 minute countdown, the MCU 12 turns on the transistor TR2 by applying the logic 1 at its pin 2, which only allows the transistor TR2 to connect the capacitor module Ecap2 to form a closed loop with the step down rectification circuit so as to smooth the DC voltage. The MCU 12 may be configured to permit the connection of both of the two capacitor modules Ecap1 and Ecap2 to the circuit for a short time period, for example 10 seconds, in order to minimize the introduction of any electrical switching noises during the switching between the different capacitor modules. At the termination of the 10 seconds, the MCU 12 turns off the transistor TR1 by applying a logic 0 to its pin 1. Namely, after 60 minutes of operation in the circuit, the capacitor module Ecap1 is disconnected while the capacitor module Ecap2 alone is connected to the step down rectification circuit to provide the function of smoothing the rectified voltage. The MCU 12 then resets its internal 60 minute countdown timer and restarts the countdown for another 60 minutes. At the termination of the second 60 minute countdown, the MCU 12 reconnects the capacitor module Ecap1 by switching the connection to the transistor TR1 before the capacitor module Ecap2 is disabled. The above steps will be repeated again and again so long as the electric power is applied to the circuit.

In order to keep track of which capacitor module is currently connected to operate in the circuit and the remaining countdown time for that capacitor module, the MCU 12 or the external memory device such as an EEprom may be configured to store the data about the operation records and updates of the capacitor modules from time to time, for instance every 10 seconds, during the normal operation of the electronic circuit. In the present embodiment, if the power is shut down, either intentionally or un-intentionally, the external EEprom memory device 14 would have saved the data about which capacitor module is in operation before the shut down and how much the countdown time is left, so that the MCU 12 will be able to reconnect the same capacitor module that is in use before the power is shut down to allow said capacitor module to complete its countdown and service in the rectification circuit after the power is resumed, based on the data saved in the EEprom memory device 14. By means of this logic control provided by the capacitor control circuit structure 10, each of the two electrolytic capacitor modules Ecap1 and Ecap2 is enabled to smooth the voltage alternately and in succession, and equally shares the operation time in the rectification circuit. Therefore if the original electrolytic capacitor module shown in FIG. 1 has an operation lifetime of 2000 hours at 105 degree Celsius, the operation lifetime provided by the capacitor control circuit structure 10 will effectively be doubled to 4000 hours by using the two electrolytic capacitor modules Ecap1 and Ecap2.

Figure 5:
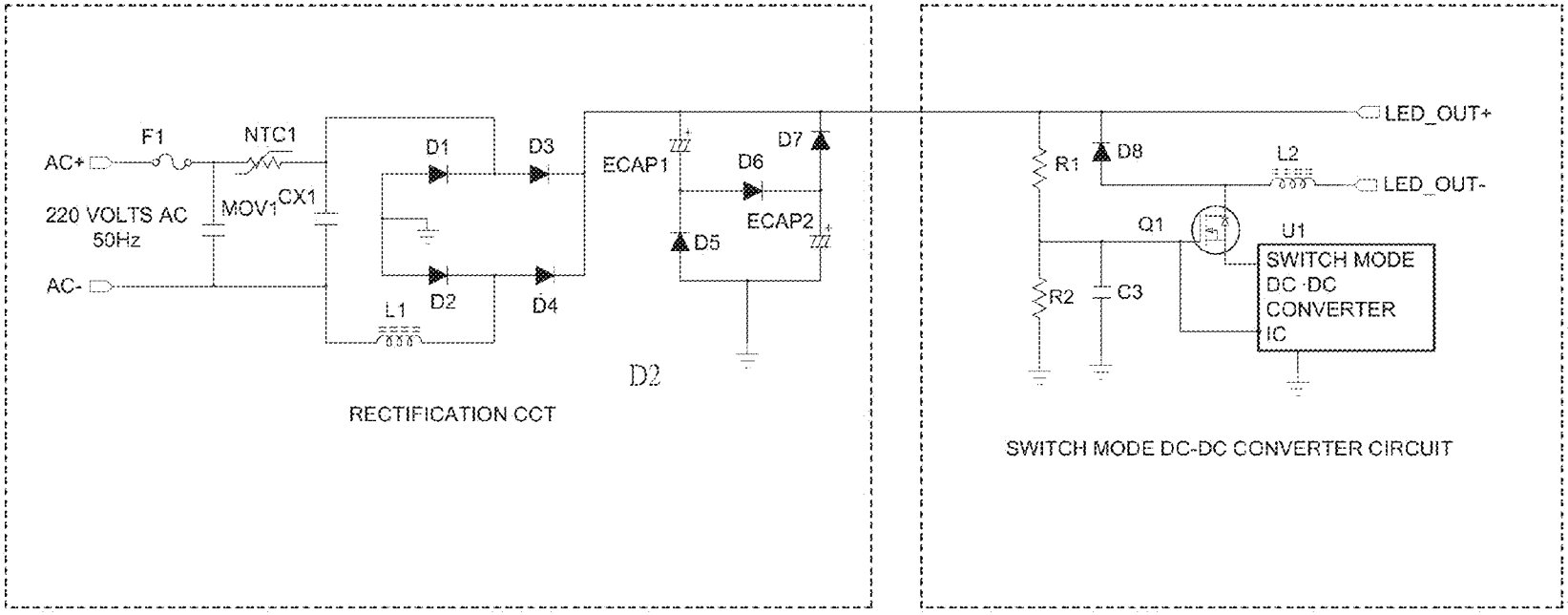
Fig. 5 (Prior Art)
FIG. 5 is a typical AC-DC converter circuit using a capacitor module containing two electrolytic capacitors in series for a LED lamp in the prior art.

Referring to FIG. 5, there is illustrated a prior art typical AC-DC switch mode converter circuit commonly used in LED lamps for illumination. In this circuit, the household AC voltage, for example 220 volts, is directly rectified into a DC voltage using a full wave bridge circuit consisting of four diodes, D1, D2, D3 and D4. A capacitor module including two electrolytic capacitors Ecap1 and Ecap2 in series connection is used to smooth the DC voltage which is then used to power a switch mode DC-DC converter circuit, thereby driving an array of LEDs to generate adequate lights for illumination purpose. It would be noted that the cost of the capacitor module used in this converter circuit to smooth the rectified DC voltage is relatively small compared to the total electronic costs. For example, the cost of the capacitor module is less than 1% of the total costs of a LED lamp. Yet the capacitor module in the converter circuit can have a significant impact on the electrical performance and the light output of the LED lamp.

As shown in FIG. 5, the AC-DC switch mode converter circuit consists of a rectification circuit and a switch mode DC-DC converter circuit. The rectification circuit is used to rectify the household AC voltage into the DC voltage, which in turn is used to power the switch mode DC-DC converter circuit that drives the array of LEDs. The switch mode DC-DC converter circuit is well known in the art and is not the essence of the invention, and therefore will not be described in detail herein.

Table 1 shows the normal electrical performance and the light output of a LED lamp circuit as shown in FIG. 5, and Table 2 shows the degraded electrical performance and the light output of the same LED lamp circuit with the ESR of the two electrolytic capacitors in the rectification circuit turned infinitely large to simulate the worst-case scenario of aging in the electrolytic capacitors.

TABLE 1

| Operating voltage | Total electric current consumption of the circuit | Light output (Measured at 1 Meter) |
|---|---|---|
| 220 VOLTS 50 Hz | 0.09 Amp. | 196 Lux |

TABLE 2

| Operating voltage | Total electric current consumption of the circuit | Light output (Measured at 1 Meter) |
|---|---|---|
| 220 VOLTS 50 Hz | 0.105 Amp | 170 LUX |

The above two tables reveal that, as the ESR in the two electrolytic capacitors Ecap1 and Ecap2 are turned infinitely large, there is a significant increase in the total electrical current consumption of the circuit, from the normal 0.09 amp in Table 1 to 0.104 amps in Table 2, while the light output decreases from 190 lux to 170 lux. It clearly shows that, as the ESR increases, the total electrical current of the circuit increases and the power consumption also increases because power consumption is the product of the operating voltage and the total electric current in a circuit, but on the other hand the light output decreases. Although the cost of the capacitor module including the two electrolytic capacitors Ecap1 and Ecap2 is relatively insignificant to the overall costs of the circuit of FIG. 5, it does have a significant impact on the performance of the circuit.

Figure 6:
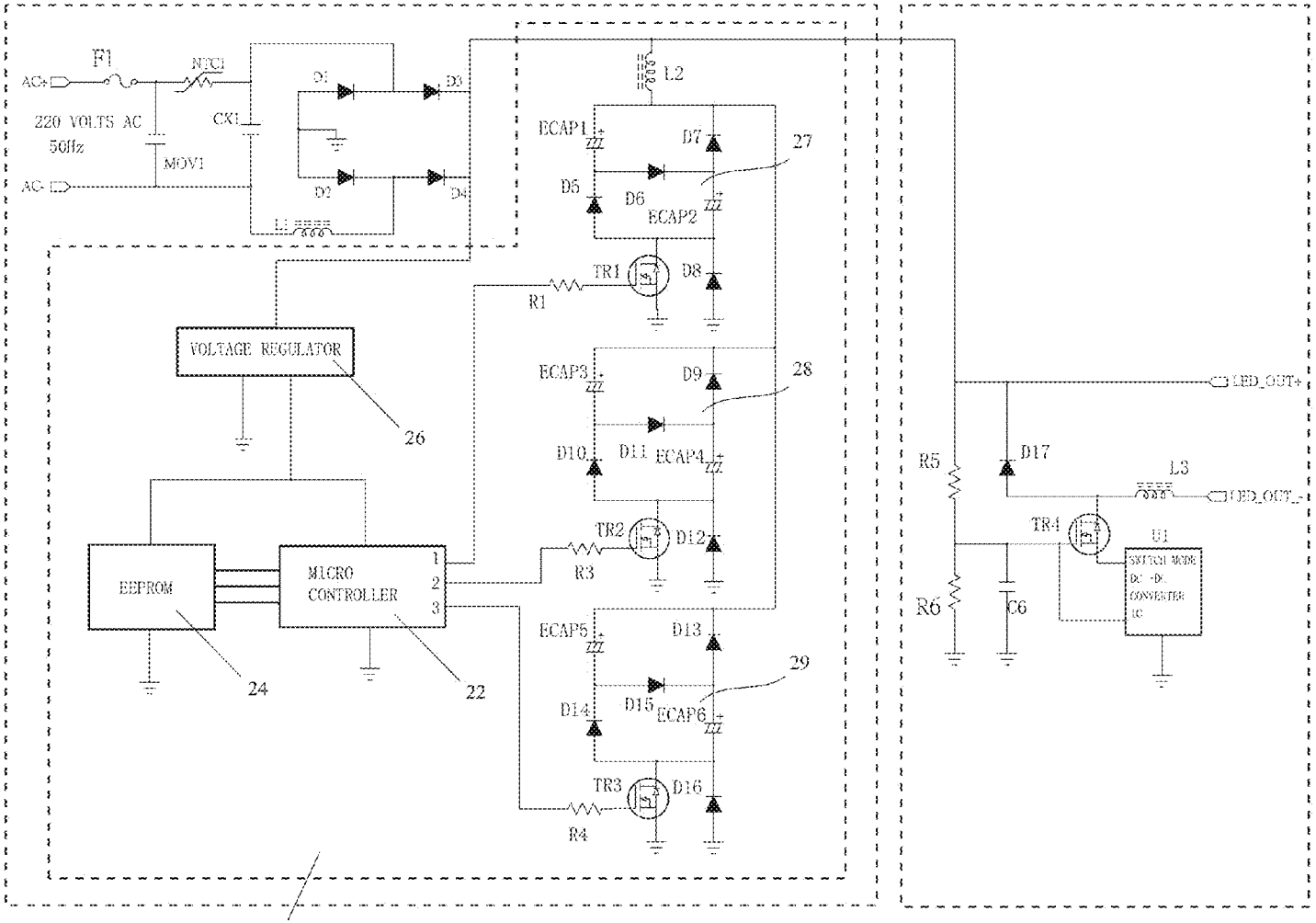
FIG. 6 is a capacitor control circuit structure constructed according to a second embodiment of the invention, which is used in the converter circuit of FIG. 5.

FIG. 6 provides a capacitor control circuit structure 20 constructed according to a second embodiment of the invention, which is used in the converter circuit of FIG. 5 to take the place of the original electrolytic capacitor module. The capacitor control circuit structure 20 of this embodiment is structurally same as the capacitor control circuit structure 10 shown in the first embodiment above, but differs in the capacitor modules to be employed. As illustrated, the capacitor control circuit structure 20 comprises first, second and third capacitor modules 27, 28 and 29, wherein the first capacitor module 27 comprises two electrolytic capacitors Ecap1 and Ecap2 in series connection in the module; the second capacitor module 28 comprises two electrolytic capacitors Ecap3 and Ecap4 in series connection in the module; and the third capacitor module 29 comprises two electrolytic capacitors Ecap5 and Ecap6 in series connection in the module. The first, second and third capacitor modules 27, 28 and 29 are of the same configuration and same function as the original electrolytic capacitor module shown in FIG. 5. A transistor TR1, TR2, TR3 for a respective one of the capacitor modules 27, 28, 29 allows for selective connection of the respective capacitor module to the rectification circuit mediated by the MCU 22. A voltage regulator 26 is included to power the capacitor control circuit structure 20.

Figure 7:
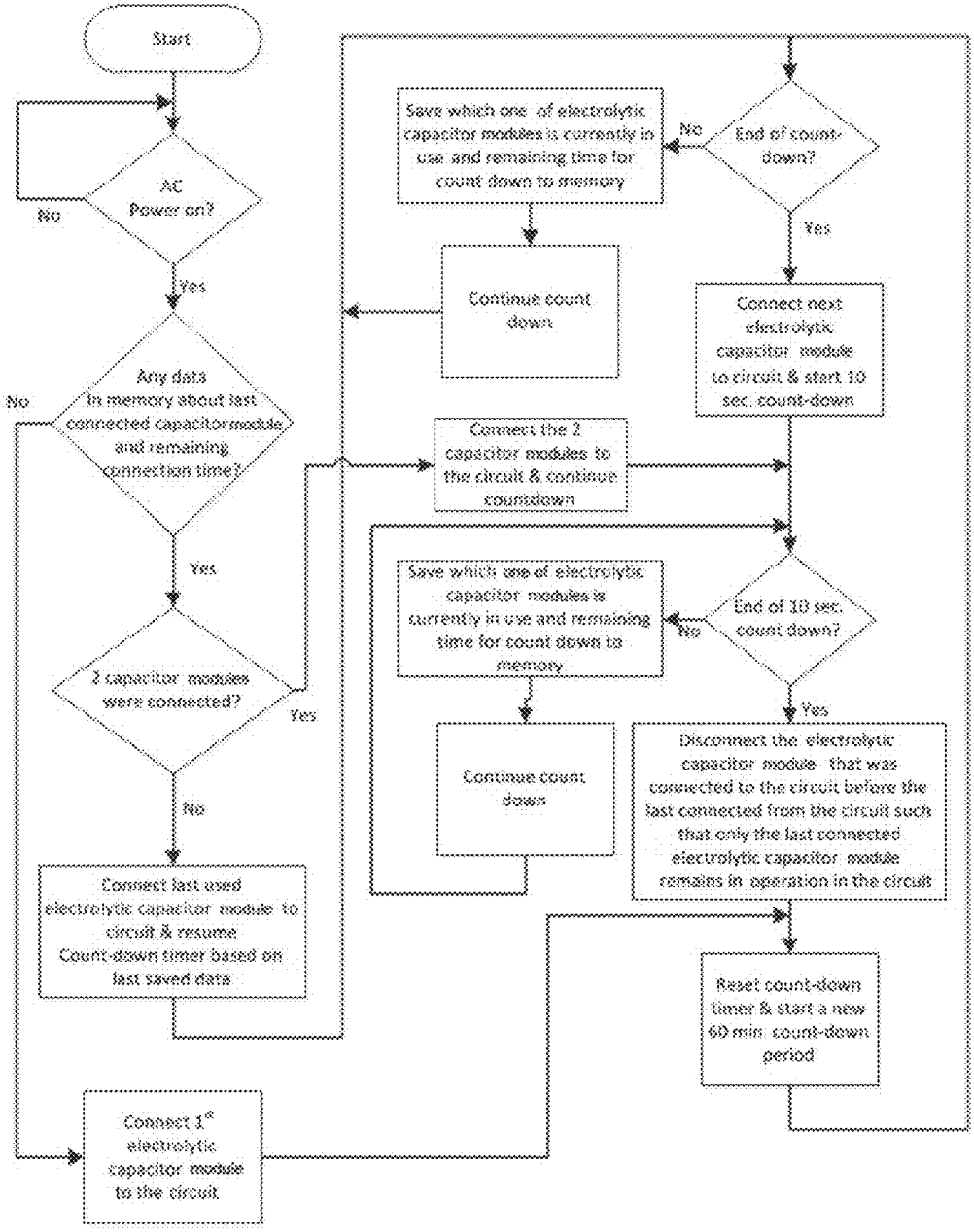
FIG. 7 is a flow chart showing the control algorithm of the capacitor control circuit structure of FIG. 6.

FIG. 7 is a flow chart showing the control algorithm of the capacitor control circuit structure 20. When the electric power is applied, the AC-DC rectification circuit, through the four diodes D1, D2, D3 and D4, rectifies a household AC voltage for example 220 volts into a DC voltage. The MCU 22 turns on the transistor TR1, which in turn connects the first capacitor module 27 to operate in the rectification circuit to smooth the DC voltage. The MCU 22 then initializes an internal countdown timer with a countdown period of 60 minutes, for example. At the end of the 60 minute countdown, the MCU 22 turns on the transistor TR2, which in turn connects the second capacitor module 28 to operate in the rectification circuit. The MCU 22 may be configured to permit the connection of both of the two capacitor modules 27, 28 to the rectification circuit for a short time period, for example 10 seconds, to minimize any switching noise during the switching between the different capacitor modules. At the termination of the 10 seconds, the MCU 22 turns off the transistor TR1 by applying a logic 0 to its pin 1, such that, after 60 minutes of operation in the circuit, the capacitor module 27 is disconnected while the capacitor module 28 alone is connected to the rectification circuit to provide the function of smoothing the rectified voltage. The MCU 22 then resets its internal countdown timer and restarts the countdown for another 60 minutes for the second capacitor module 28. At the end of this 60 minute countdown, the MCU 22 permits both the capacitor modules 28, 29 to be in concurrent operation for about 10 seconds before turning off the capacitor module 28. At the end of the 10 second countdown, the MCU 22 turns off the transistor TR2 and the transistor TR3 is still on to connect the capacitor module 29 to the rectification circuit to smooth the voltage. The MCU 22 then resets its internal countdown timer and restarts the counter for another 60 minutes for the third capacitor module 29. At the end of another 60 minutes countdown, the MCU 22 turns on the transistor TR1 which in turn reconnects the capacitor module 27 to the rectification circuit. Again, the MCU 22 may permit both the capacitor modules 27, 29 to be in concurrent operation for about 10 seconds before turning off the capacitor module 29. The above steps will be repeated again and again.

Like the first embodiment discussed above, the external EEprom memory device 24 is configured to store and update the data about the operation records and updates of the three capacitor modules 27, 28, 29 regularly, for instance every 10 seconds, during the normal operation of the electronic circuit. If the power is shut down, either intentionally or un-intentionally, the external EEprom memory device 14 would have saved the data about which capacitor module is in operation before the shut down and how much the countdown time of that capacitor module is left, allowing the MCU 22 to reconnect the same capacitor module that is in use before the power is shut down to enable said capacitor module to complete its countdown and service in the rectification circuit after the power is resumed, based on the data saved in the EEprom memory device 24. By means of this logic control provided by the capacitor control circuit structure 20, each of the three capacitor modules 27, 28, 29 will smooth the voltage alternately and in succession, and equally shares the operation time in the rectification circuit. Therefore, assuming that the capacitor module shown in FIG. 5 has an operation lifetime of 2000 hours at 105 degree Celsius, the operation lifetime provided by the capacitor control circuit structure 20 will effectively be tripled to 6000 hours by using the three capacitor modules 27, 28 and 29.

Figure 8:
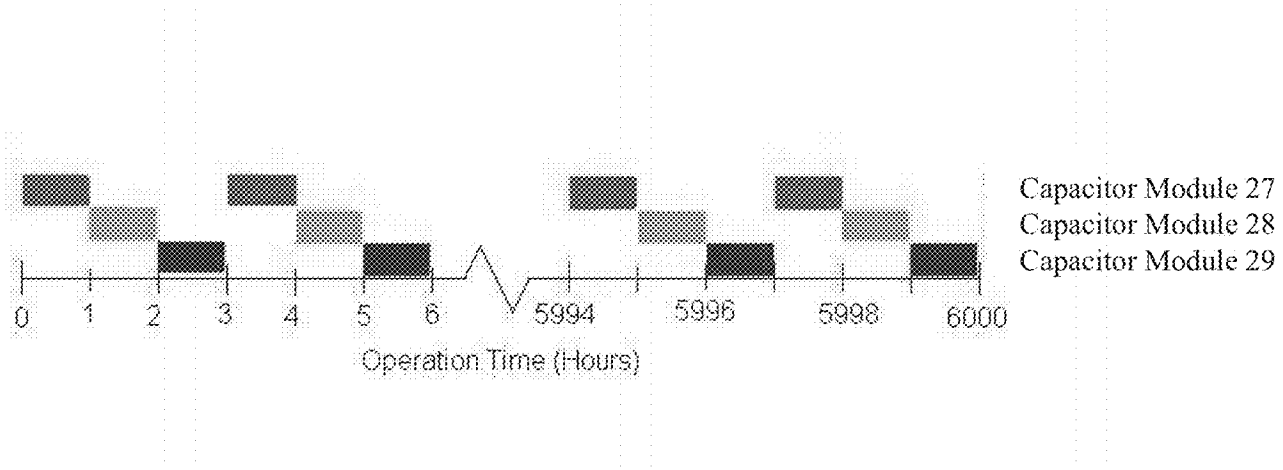
FIG. 8 is an illustrative diagram of an expected operation lifetime of the capacitor control circuit structure of FIG. 6.

FIG. 8 illustrates an illustrative diagram of an expected operation lifetime of the capacitor control circuit structure 20. As can be seen, the three capacitor modules 27, 28 and 29 operate in the circuit alternately and in succession at an equal interval of time. As a consequence, the operation lifetime of the three capacitor modules under the logic control of the capacitor control circuit structure 20 is the sum of the lifetime of the three capacitor modules 27, 28 and 29.

In the capacitor control circuit structure 10 or 20, the external EEprom memory device 14 or 24 is used to record the data about which capacitor module is currently in use and the remaining operation time of that capacitor module in the rectification circuit when the power is down either intentionally or unintentionally. Hence upon the resumption of power the capacitor module that was last in use can be actuated to be reconnected to complete its remaining operation time in the rectification circuit, so as to assure each capacitor module indeed equally shares the operation time to maximize their operation lifetime in the electronic circuit for different kinds of applications.

Figure 9:
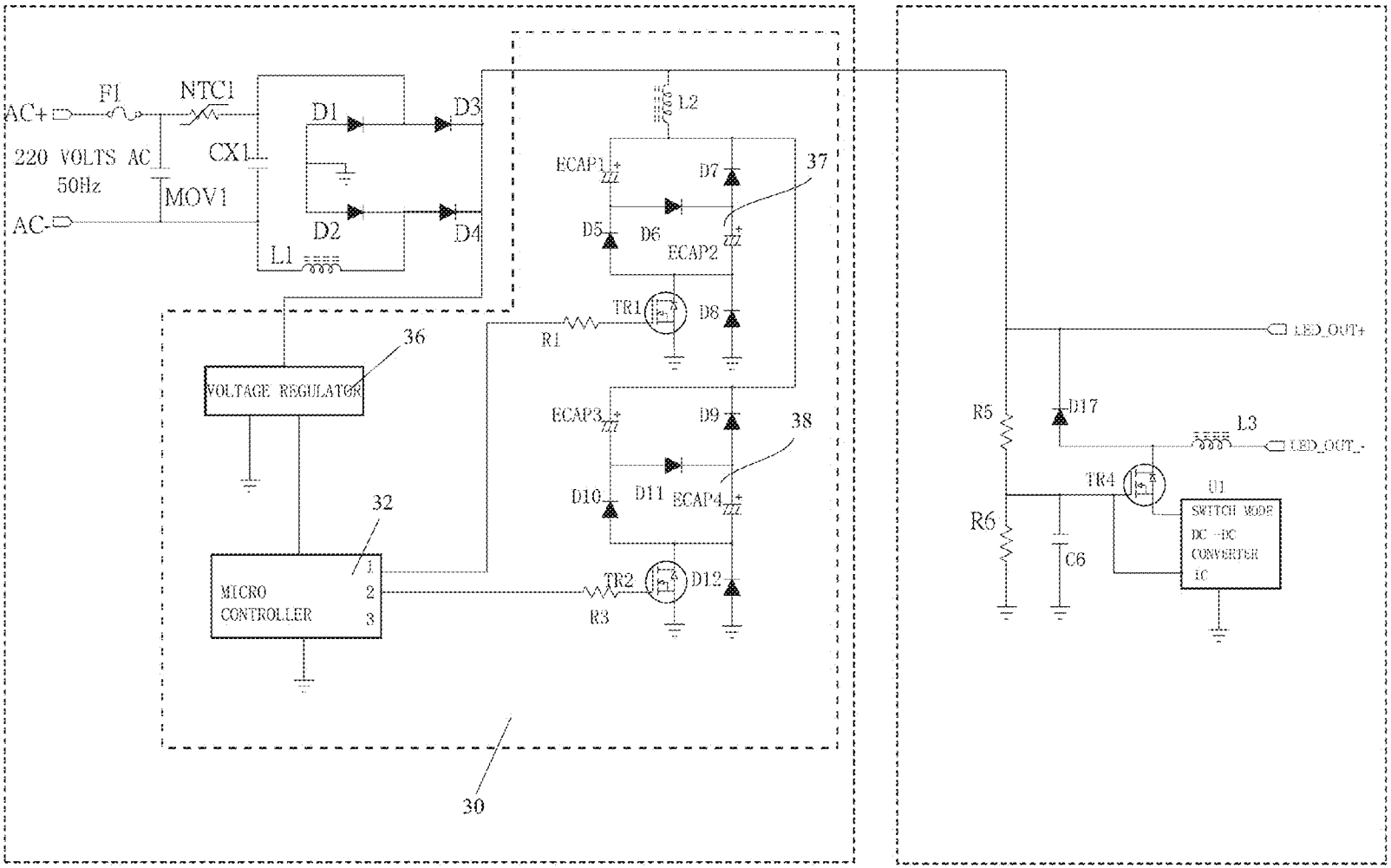
FIG. 9 is a capacitor control circuit structure constructed according to a third embodiment of the invention, which is used in the converter circuit of FIG. 5.
Figure 10:
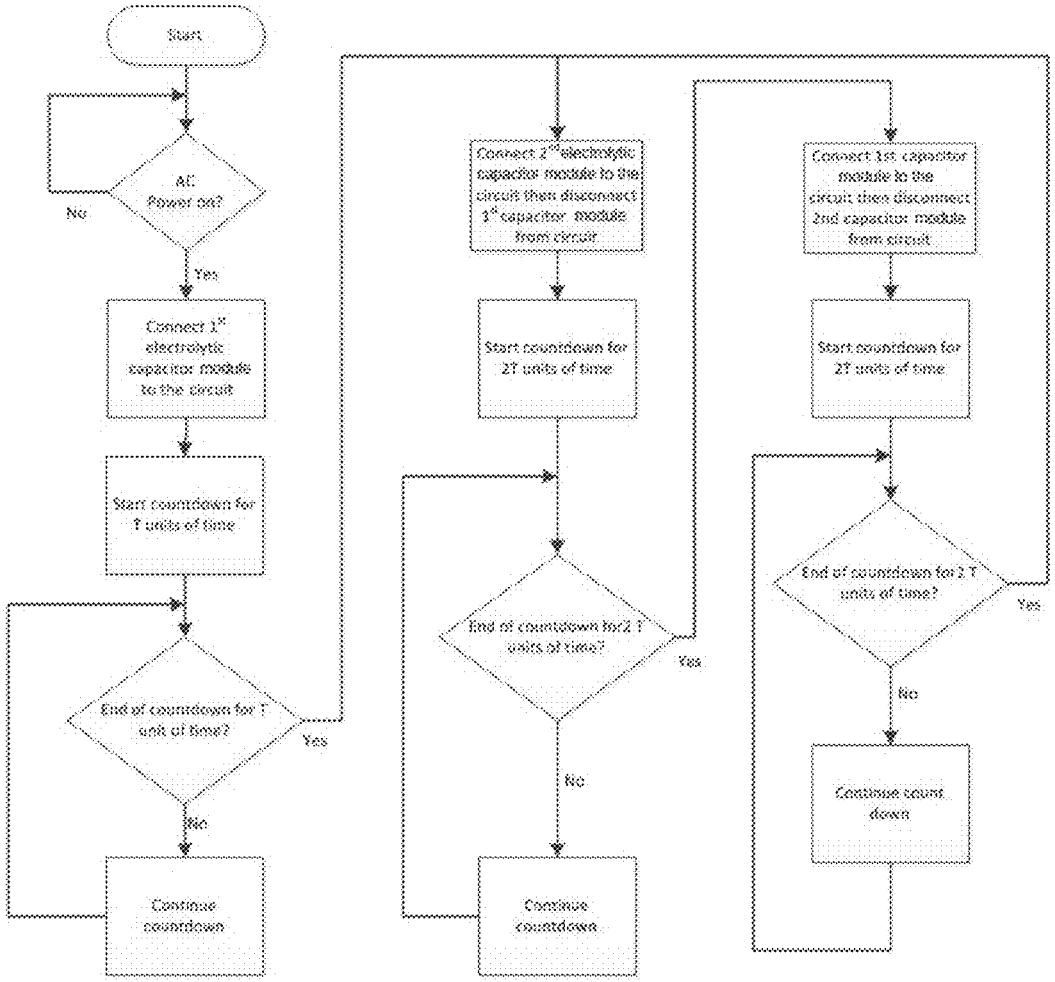
FIG. 10 is a flow chart showing the control algorithm of the capacitor control circuit structure of FIG. 9.

FIGS. 9 and 10 provide a capacitor control circuit structure 30 constructed according to a third embodiment of the invention, which may be used in the circuit of FIG. 5 continuously for an extended period of time (for example more than 10 hours) or in the non-stop-use scenarios. The capacitor control circuit structure 20 may take the place of the original capacitor module shown in FIG. 5. For the simplicity and clarity, the capacitor control circuit structure 30 of this embodiment comprises first and second capacitor module 37, 38 which are of the same configuration and same function as the original capacitor module in FIG. 5, wherein the first capacitor module 37 comprises two electrolytic capacitors Ecap1 and Ecap2 in series connection in the module; and the second capacitor module 38 comprises two electrolytic capacitors Ecap3 and Ecap4 in series connection in the module. Likewise, a transistor TR1, TR2 for a respective one of the capacitor modules 37, 38 allows for selective connection of the respective capacitor module to the rectification circuit mediated by the MCU 32. A voltage regulator 36 is included to power the capacitor control circuit structure 30. The capacitor control circuit structure 30 differs significantly from the ones discussed in the first and second embodiments above in that no memory device, either internal or external, is present in the capacitor control circuit structure 30.

In the capacitor control circuit structure 30, each of the capacitor modules 37, 38 are configured to operate for a predetermined time period of 2T units. However, every time the power is turned on, the first capacitor module 37 is always actuated to operate for half of the predetermined time period, i.e. a time period of T units. Then the second capacitor module 38 takes over to operate for the predetermined time period of 2T units, and at the end of the 2T units, the operation of the capacitor control circuit structure 30 switches back to the first capacitor module 37 for the next 2T units. Thereafter the two capacitor modules 37, 38 would be actuated by the MCU 32 to take turns to operate for the predetermined time period of 2T units. In this way, the amounts of time for each of the two capacitor modules to operate are expected to be generally equal.

The basic principle that the capacitor modules 37, 38 of the capacitor control circuit structure 30 operate for the substantially equal time period to maximize their operation lifetime in the capacitor control circuit structure 30 is described with reference to FIGS. 11 and 12 as follows.

Let's suppose that, at the time when the power is turned off, each of the capacitor modules 37, 38 takes turns to operate for 2T units of time for n instances beginning from the point of time T, and t is defined as the amount of time elapsed since operation of the rectification circuit last switched from one capacitor module to the other. Therefore $0 \le t \le 2T$. Also suppose that X and Y are the amounts of time the rectification circuit is operated by the capacitor modules 37, 38 respectively when the power is turned off.

In each instance, the capacitor modules 37, 38 each operates for the time period 2T units in the rectification circuit, therefore the length of each instance is 4T units (i.e. 2T units by the capacitor module 37+2T units by the capacitor module 38). The equation for the number of the instances is set up as following:

$$n=\text{floor}((X+Y-T)/4T)$$

where, n is the number of operation instances of the capacitor control circuit structure, X is the amount of operation time of the first capacitor module 37 when the power is turned off, Y is the amount of operation time of the second capacitor module 38 when the power is turned off, and T is half of the predetermined time period set for each of the capacitor modules 37, 38.

Figure 11:
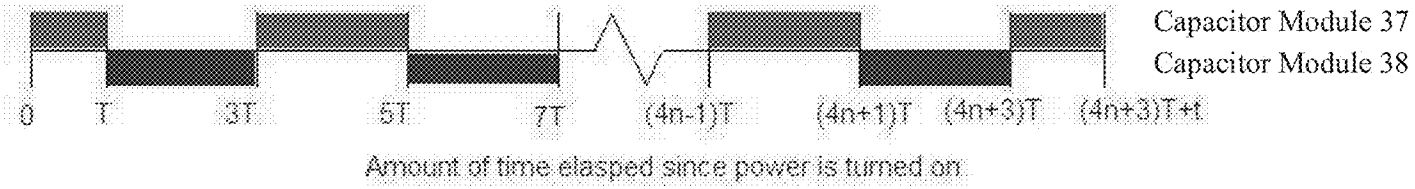
FIG. 11 is an illustrative diagram of the sequence of operation of the capacitor control circuit structure of FIG. 9, where the first capacitor module Ecap1 is operating immediately before the power is turned off.

If the first capacitor module 37 is operating in the rectification circuit when the power is turned off and both the capacitor modules 37, 38 have operated in the rectification circuit for 2T units n times, then the total operation time of the first capacitor module 37 in the rectification circuit is X=T+2T+2T+ . . . +2T+t=T+n(2T)+t; and the total operation time of the second capacitor module 38 in the rectification circuit is Y=2T+2T+ . . . +2T=(n+1)2T, which is illustratively shown in Table 3 below and would be better understood with reference to FIG. 11.

TABLE 3

| | Instance | | | | | | Total Operation |
|---|---|---|---|---|---|---|---|
| | 1 | 2 | . . . | n | | | Time |
| first capacitor module 37 | T | 2T | 2T | . . . | 2T | t | X |
| second capacitor module 38 | 2T | 2T | . . . | 2T | 2T | | Y |

Therefore, X−Y=[T+n(2T)+t]−[(n+1)2T]=t−T. This amount of time shows by how much the operation time of the first capacitor module 37 exceeds the operation time of the second capacitor module 38 in the cases where the rectification circuit is operated by the first capacitor module 37 at the time when the power is turned off.

Figure 12:
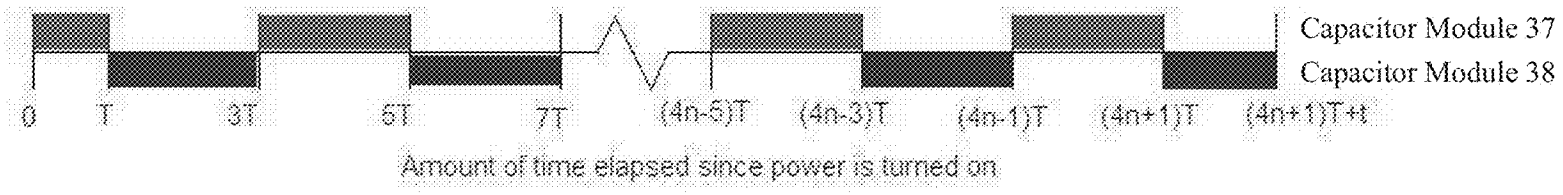
FIG. 12 is an illustrative diagram of the sequence of operation of the capacitor control circuit structure of FIG. 9, where the second capacitor module Ecap2 is operating immediately before the power is turned off.

If the second capacitor module 38 is operating in the rectification circuit when the power is turned off and both the capacitor modules 37, 38 have operated in the rectification circuit for 2T units n times, then the total operation time of the first capacitor module 37 in the rectification circuit is X=T+2T+2T+ . . . +2T=T+n(2T); and the total operation time of the second capacitor module 38 in the rectification circuit is Y=2T+2T+ . . . +2T+t=n(2T)+t, which is illustratively shown in Table 4 below and would be better understood with reference to FIG. 12.

TABLE 4

| | Instance | | | | | | Total Operation |
|---|---|---|---|---|---|---|---|
| | 1 | 2 | . . . | n | | | Time |
| first capacitor module 37 | T | 2T | 2T | . . . | 2T | | X |
| second capacitor module 38 | 2T | 2T | . . . | 2T | t | | Y |

Therefore, X−Y=[T+n(2T)]−[n(2T)+t]=T−t. This amount of time shows by how much the operation time of the second capacitor module 38 exceeds the operation time of the first capacitor module 37 in the cases where the rectification circuit is operated by the second capacitor module 38 at the time when the power is turned off.

Under the normal operation, the likelihood that the rectification circuit is operated by either of the capacitor modules 37, 38 when the power is turned off is expected to be equal in view of E(X−Y)=0.5(t−T)+0.5(T−t)=0, thus the amounts of time the rectification circuit is operated by each capacitor module in the rectification circuit are expected to be equal. Even in the worst case scenario, if the parameter T is set to be small, for example 5 minutes, the difference of the equations X−Y=t−T and X−Y=T−t would be insignificant. By operating in the electronic circuit for the substantially equal time period, all the capacitor modules in the capacitor control circuit structure 30 are endowed with the maximum operation lifetime.

Now turning back to FIGS. 9 and 10, the capacitor control circuit structure 30 is provided for use in the AC-DC converter circuit of FIG. 5. When the electric AC power is applied, the full wave bridge rectification circuit that consists of diodes D1, D2, D3 and D4 rectifies the AC voltage into a DC voltage. The MCU 32 then turns on the field effect transistor TR1 to connect the first capacitor module 37 that includes the two electrolytic capacitors Ecap1 and Ecap2 in series connection to the rectification circuit so as to smooth the voltage. The MCU 32 then starts to count down for half of the predetermined time period of T unit of time, for example T is set to be 5 minutes. At the end of this 5 minutes count down, the MCU 32 turns on the field effect transistor TR2 which in turn connects the second capacitor module 38 to operate in the rectification circuit. Then the MCU 32 turns off the transistor TR1 and disconnects the first capacitor module 37 from the rectification circuit such that only the second capacitor module 38 is now connected to operate in the rectification circuit. The MCU 32 then starts to count down for the predetermined time period of 2T unit of time. As mentioned above, T is set to equal to 5 minutes, therefore 2T unites of time is 10 minutes. At the end of this 10 minutes countdown, the MCU 32 turns on the transistor TR1 and connects the first capacitor module 37 to operate in the rectification circuit before the second capacitor module 38 is disconnected from the rectification circuit. Then MCU 1 starts to countdown for 2T units of time, and the sequence continues until the electric power is turned off. Although the capacitor control circuit structure 30 uses the MCU 32, other logical devices including programmable counters are possible.

According to the capacitor control circuit structure 30, the two capacitor modules 37, 38 are controlled to take turns to operate in the rectification circuit, and each of them shares approximately half of the operation time in the rectification circuit. By means of this logic control, each of the two capacitor modules 37, 38 is enabled to smooth the voltage alternately and in succession, and equally shares the operation time in the rectification circuit. Therefore, assuming that the original capacitor module in FIG. 5 has an operation lifetime of 2000 hours at 105 degree Celsius, the operation lifetime of the capacitor control circuit structure 30 will effectively be doubled to about 4000 hours by using the two capacitor modules 37, 38.

The three embodiments of the invention described above utilize two different methods to regulating the operation of the capacitor modules to extend their operation lifetime. These methods assure that the capacitors modules employed in the capacitor control circuit structure equally shares their operation time in the electronic circuit to maximize each of the capacitor module's operation life in the circuit. In some applications the capacitor control circuit structure can simply be configured to alternately switch between the capacitor modules in use sequentially at a relatively short time interval of every 10 seconds for example. Although such an alternating switching will fail to assure each of the capacitor modules equally share their operation time in a circuit, such that in a long run, one capacitor module may have operated in the circuit for a more extended time period and hence aged sooner than the other capacitor modules in a circuit, the operation lifetime of the capacitor control circuit structure as a whole is still extended to some extent. This is still within the scope of the invention.

Thus, the present invention provides a method which can cost-effectively extend the operation lifetime of a capacitor module for use in the electronic circuit employing the capacitor module.

Having sufficiently described the nature of the present invention according to some preferred embodiments, the invention, however, should not be limited to the structures and functions of the embodiments and drawings. It is stated that insofar as its basic principle is not altered, changed or modified it may be subjected to variations of detail. Numerous variations and modifications that are easily obtainable by means of the skilled person's common knowledge without departing from the scope of the invention should fall into the scope of this invention.

What is claimed is:

1. A method for improving operation lifetime of a capacitor module in an electronic circuit employing the capacitor module, comprising the steps of:

providing two or more capacitor modules of same configuration; and controlling alternately a respective one of the capacitor modules to operate in the electronic circuit for a same first predetermined period of time;

wherein the controlling step comprises always actuating a first one of the capacitor modules to operate for half of the first predetermined period of time every time the electronic circuit is turned on.

2. The method according to claim 1, wherein, beginning with a second one of the capacitor modules, each of them is alternately controlled to operate in the electronic circuit for the first predetermined period of time, after the operation of the first capacitor module.

3. The method according to claim 1, comprising the step of configuring the respective capacitor module and a ready-to-operate one of the capacitor modules to operate concurrently in the electronic circuit for a second predetermined period of time before the operation of the respective capacitor module is disenabled.

4. The method according to claim 1, wherein the capacitor module is an electrolytic capacitor module.

5. A capacitor control circuit structure for use in an electronic circuit, comprising:

two or more capacitor modules of same configuration;

at least one switching device in operative connection with a respective one of the capacitor modules; and a capacitor module controller for alternately controlling the operative connection of the at least one switching device with the respective one of the capacitor modules for a same first predetermined period of time, such that the respective capacitor module is actuated to operate in the electronic circuit during the first predetermined period of time;

wherein the capacitor module controller is configured to always actuate a first one of the capacitor modules to operate for half of the first predetermined period of time every time the electronic circuit is turned on.

6. The capacitor control circuit structure according to claim 5, further comprising a voltage regulator arranged prior to the capacitor module controller in order to ensure that the controller functions properly.

7. The capacitor control circuit structure according to claim 5, wherein the capacitor module controller is configured as a microcontroller programmed to alternately control each of the capacitor modules to operate in the electronic circuit for the first predetermined time period.

8. The capacitor control circuit structure according to claim 5, wherein after the half of the first predetermined period of time, the capacitor module controller, beginning with a second one of the capacitor modules, alternately controls each of the capacitor modules to operate in the electronic circuit for the first predetermined period of time.

9. The capacitor control circuit structure according to claim 5, wherein the capacitor module controller is configured to enable the respective capacitor module and a ready-to-operate one of the capacitor modules to operate concurrently in the electronic circuit for a second predetermined period of time before the operation of the respective capacitor module is disenabled.

10. The capacitor control circuit structure according to claim 5, wherein the switching device is configurable as a transistor for the respective capacitor module, thereby allowing the capacitor module controller to control the connection of the transistor to enable the operation of the respective capacitor module.

11. A driver circuit for a LED lamp, comprising the capacitor control circuit structure according to claim 5.

12. The capacitor control circuit structure according to claim 5, wherein the capacitor module controller is configured as a programmable counter or a microcontroller (MCU).

* * * * *